US006631680B2

(12) United States Patent
Metzler

(10) Patent No.: US 6,631,680 B2
(45) Date of Patent: Oct. 14, 2003

(54) PRINTING UNIT FOR A PRINTING MACHINE

(75) Inventor: Patrick Metzler, Gettorf (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/929,853

(22) Filed: Aug. 14, 2001

(65) Prior Publication Data

US 2002/0117064 A1 Aug. 29, 2002

(30) Foreign Application Priority Data

Aug. 18, 2000 (DE) ..... 100 40 361

(51) Int. Cl.[7] ..... B41F 7/06; B41F 13/20
(52) U.S. Cl. ..... 101/463.1; 101/217; 101/232
(58) Field of Search ..... 101/463.1, 450.1, 101/467, 465, 136, 141, 217, 232

(56) References Cited

U.S. PATENT DOCUMENTS

| | | | | |
|---|---|---|---|---|
| 3,965,818 A | * | 6/1976 | Ishii | 257/699 |
| 4,931,839 A | | 6/1990 | Tompkins et al. | 399/66 |
| 5,351,616 A | * | 10/1994 | Gelinas et al. | 101/218 |
| 5,732,314 A | | 3/1998 | Tsukida et al. | 399/302 |
| 5,983,062 A | | 11/1999 | Sameshima | 399/302 |
| 6,082,263 A | * | 7/2000 | Koguchi et al. | 101/456 |

FOREIGN PATENT DOCUMENTS

DE 19921271 A1 * 12/1999 ..... B41F/21/00

OTHER PUBLICATIONS

JP 06–236 118 A (Aug. 23, 1994), Computer translation by JPO.
JP 11305575 A (May 11, 1999), Patent Abstracts of Japan.

* cited by examiner

*Primary Examiner*—Daniel J. Colilla
(74) *Attorney, Agent, or Firm*—Lawrence P. Kessler

(57) ABSTRACT

A printing unit (1) for a printing machine, having an image cylinder (2), an image generating device (3) for setting an image on the peripheral surface (4) of the image cylinder (2), and an image transfer cylinder (5) which transfers the image from the image cylinder (2) to a printing substrate (6), the image transfer cylinder (5) having a resilient cover (7) which exhibits a deformation (10, 10') in the force transmission areas (8, 9), and a transport belt (11) that carries the printing substrates (6) and is supported by a back-pressure cylinder (12) driving the image transfer cylinder (5) and the latter driving the image cylinder (2), by friction. The printing unit has a continuous image cylinder speed ($v_{(ü)}$). This is achieved by the back-pressure cylinder (12) being mounted such that it can be displaced with respect to the image transfer cylinder (5) with a travel-dependent pressing force ($F_{(s)}$) which is dimensioned such that the speed of the image cylinder (2) remains constant with respect to changes in the effective radius (r) for driving the image transfer cylinder (5).

10 Claims, 6 Drawing Sheets

PRINTING UNIT FOR A PRINTING MACHINE

FIELD OF THE INVENTION

The invention relates to a printing unit for a printing machine, having an image cylinder, an image generating device for setting an image on the peripheral surface of the image cylinder, and an image transfer cylinder which transfers the image from the image cylinder to a printing substrate, the image transfer cylinder having a resilient cover which exhibits a deformation in the force transmission areas, and a transport belt that carries the printing substrates, supported by a back-pressure cylinder, driving the image transfer cylinder and the latter driving the image cylinder by friction.

BACKGROUND OF THE INVENTION

A printing unit is shown in DE 199 34 658. The configuration of this printing unit compensated for the non-roundness of the driven image cylinder by an appropriate configuration and dimensioning of the image cylinder, image transfer cylinder and the resilient cover of the latter. In addition to compensating for non-roundness of the image cylinder, however, in such printing unit there is the problem that the transmission ratio of the drive also changes because, between the transport belt and image transfer cylinder, printing substrates and printing-substrate-free gaps alternate, as a result of which the radius which is definitive for the transmission ratio changes, and therefore a discontinuity in the image cylinder speed is likewise caused. The same can also occur as the result of non-roundness of the image transfer cylinder. The last-named fault cause may be counteracted, in exactly the same way as the non-roundness of image cylinders, by high precision in the roundness of the cylinders; however, there is no such possibility with respect to the change in the radius arising from printing substrates.

SUMMARY OF THE INVENTION

The invention is therefore based on the object of developing a printing unit in such a way that a continuous image cylinder speed is achieved. According to the invention, the object is achieved by a back-pressure cylinder being mounted such that it can be displaced with respect to the image transfer cylinder with a travel-dependent pressing force, which is dimensioned such that the speed of the image cylinder remains constant with respect to changes in the effective radius for driving the image transfer cylinder.

The invention is based on the following facts: in the case of the drive by friction, two effects occur which change the transmission ratio. Firstly, transmission ratio is changed by the change in effective radii when there is a printing substrate between the transport belt and image transfer cylinder, or the radius of the latter exhibits fluctuations. Secondly, the transmission ratio is determined by the extent of the deformation of the resilient cover in the force transmission areas. One of these areas is between the transport belt, with or without paper, and the image transfer cylinder; the other is between the image transfer cylinder and the image cylinder. A deformation of this kind leads to the resilient cover, in order to pass through the nip between the image transfer cylinder and image cylinder or transport belt, assuming a higher speed than that which corresponds to the rotation of the image transfer cylinder.

The speed of the image cylinder is therefore determined by the speed of the transport belt and the influence of the elastic deformations of the cover of the image transfer cylinder at the two force transmission points. This influence is referred to as overdrive. Were this overdrive identical at both force transmission points, then the two overdrives would cancel each other out. With respect to the drive of the image transfer cylinder there would be a reduction in speed as compared with the transmission of force by rigid surfaces and, with respect to the drive of the image cylinder, there would be acceleration. However, the overdrives are different. The overdrive between the image transfer cylinder and the image cylinder is determined by the mounting of this cylinder and the pressing pressure resulting from this. The overdrive between the transport belt and the image transfer cylinder is determined by the pressing force of the back-pressure cylinder, since this causes the deformation of the resilient cover in the area of the contact between transport belt and image transfer cylinder.

Were the transmission ratios, that is to say the effective radii and the overdrives, constant, then it would be sufficient to take this into account in generating the images. In actual fact, these overdrives fluctuate. In order to compensate for the fluctuation in the overdrive between image transfer cylinder and image cylinder because of the non-roundness of the latter, the above-cited DE patent application specifies a solution, the compensation of the fluctuations of the overdrive between transport belt with backpressure cylinder and image transfer cylinder is the subject of the invention. Without the measure according to the invention, an enlargement of the radius of the image transfer cylinder, which occurs when a printing substrate is located between the transport belt and image transfer cylinder, would lead to the transmission ratio being changed in the direction of slower rotation of the image transfer cylinder, since the enlargement of the radius acts in this direction. In the case of a rigid or normal spring mounting, the pressing force also increases in this case, and therefore so does the overdrive, which likewise leads to slower rotation of the image transfer cylinder, that is to say the error is increased further.

The invention is based on the finding that a configuration is needed in which the overdrive decreases with enlarged radius, it then being possible for this decrease in the overdrive to be adjusted in such a way that the speed reduction of the image transfer cylinder, and therefore of the image cylinder resulting from the enlarged radius, is opposed by a speed increase, compensating for this, as a result of a decreasing overdrive. This then balances out the effects of each radius enlargement, irrespective of whether this is attributable to the presence of a printing substrate in the transfer area or whether this is based on non-roundness of the image transfer cylinder. In this way, it is possible to achieve the situation where the image cylinder speed is independent of the influences just mentioned and therefore becomes constant. The influence of non-roundness of the image cylinder may be compensated for, to the extent that it is relevant, by the measures of DE 199 34 658, it being possible for these measures to be combined with the measures of this invention.

The advantage of the measure according to the invention is in the fact that the compensation adjusts itself, and neither a loss of quality nor compensation in the image generation has to be tolerated. The latter would be a complicated and expensive control system, particularly since the changes in the effective radius would have to be registered and taken into account without delay.

Exact dimensioning of the travel-dependent pressing force is achieved if the product of the transmission ratio which results from the respective effective radius and the transmission ratio which results from the respective deformations of the resilient cover in the force transmission area between the transport belt, with or without printing substrate, and the image cylinder remains constant. This dimensioning is the optimum, this being achieved more or less exactly, depending on the configuration of the invention. As a rule, a tolerance is predefined, within which the fluctuations are permissible, the tolerance depending on the respective quality requirements on a print.

Provision is expediently made for a force element to generate the travel-dependent pressing force, it being possible for a force element of this type to be configured in an extremely wide range of ways.

One proposal is that the force element is a controlled actuating element, data for this control system then having to be available. This data can be determined, for example, by inputting a substrate thickness. However, it is also possible for a sensor to be provided for registering the substrate thickness, and also a control system, the latter determining the pressing force with the aid of the substrate thickness. The actuating element can, for example, be designed in such a way that it acts on the piston/cylinder arrangements operated by a medium. These can be pneumatic or hydraulic cylinders.

A particularly simple and cost-effective configuration provides for the force element to be springs, which act on the backpressure cylinder with the pressing force. The advantage of this configuration is that the compensation can be achieved with simple mechanical devices, without any outlay on control. Use is preferably made of springs, which, at least in one characteristic-curve zone, have a falling force/travel characteristic. Although such a characteristic-curve zone will as a rule not achieve the optimum to one hundred percent, the prescribed tolerances can generally be achieved in this simple way. The springs expediently each have an adjusting element, with which the characteristic-curve zone can be set as a working zone. By such a setting, the optimum working zone within the force/travel characteristic curve can also be found, in order to set the pressing force as optimally as possible. With respect to the springs, it is proposed that these be disk springs, since such disk springs exhibit the aforementioned characteristic-curve zones. In this regard, reference is made to the "Dubbel" Mechanical Engineering Pocket Book, 18th Edition G56, FIG. 7.

One further possibility for configuring the force element is that this is a lever-mounted weight. If, in the case of such a weight, the effective lever arm is shortened as a function of the travel, by an appropriate configuration of the lever in one travel direction, then it is likewise possible for a falling force/travel characteristic curve of this type to be achieved. This is only one example; various configurations of force elements with levers are possible, if appropriate with different transmission ratios.

Of course, the force element may also be a combination of at least two force-generating elements. For example, it is possible to combine a spring with a normal characteristic curve with a lever-mounted weight. In this case, the combination is expediently made in such a way that the sum of the force/travel characteristic curves of the force-generating elements result in at least one falling characteristic-curve zone, which is used as the working zone. Of course, a combination of passive and active force elements is also possible.

BRIEF DESCRIPTION OF THE DRAWINGS

The invention will be explained below using the drawing, in which.

DETAILED DESCRIPTION OF THE INVENTION

Figure 1:
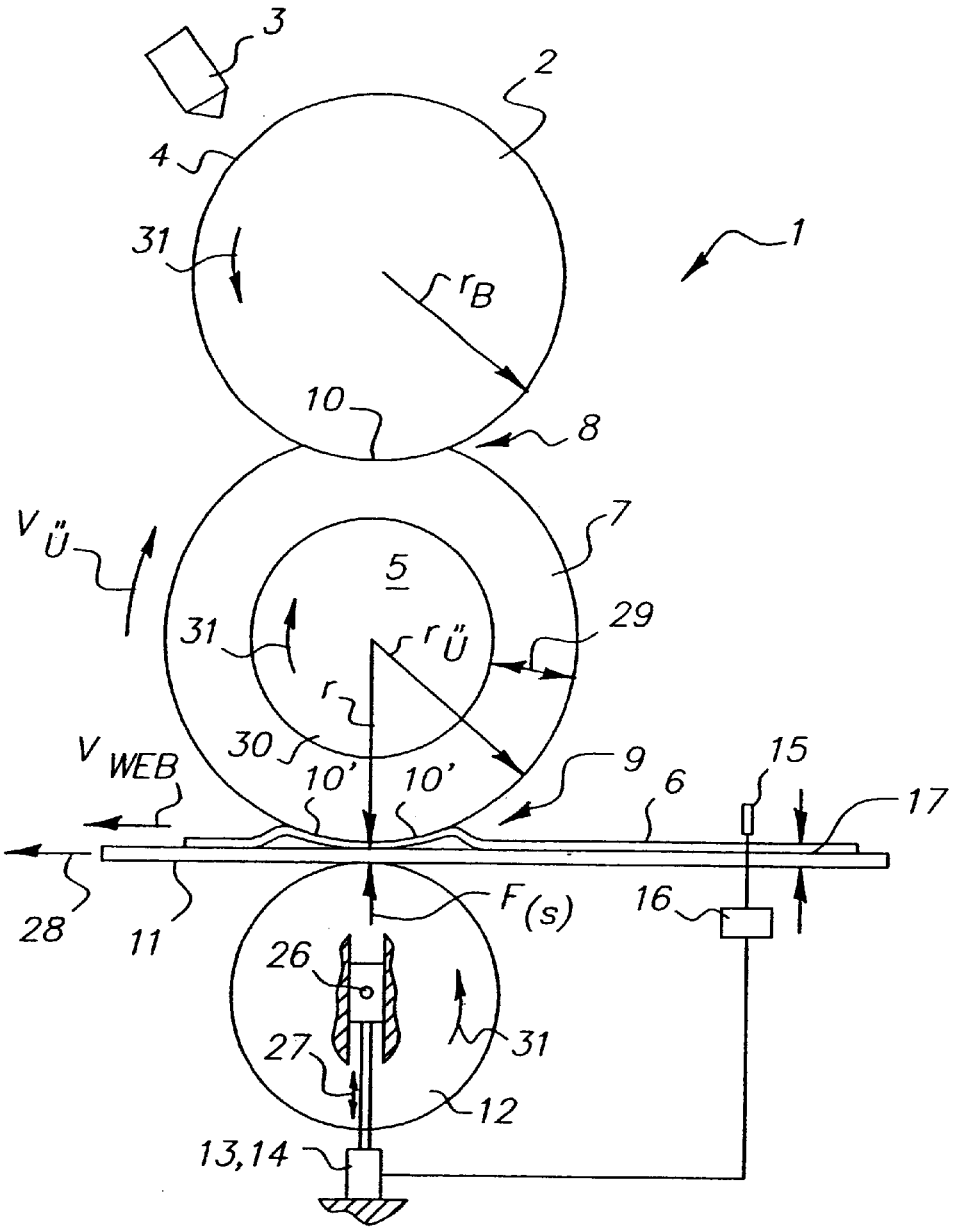
FIG. 1 shows an exemplary embodiment of a printing unit configured in accordance with the invention.

FIG. 1 shows an exemplary embodiment of a printing unit 1 configured in accordance with the invention. The printing unit 1 has an image cylinder 2, on whose peripheral surface 4 a printing image is produced by an image-generating device 3. This is generally an electrostatic printing image, most often a color separation from a multicolor print. Multicolor printing machines have four or more printing units 1. The printing images are transferred from the image cylinder 2 to an image transfer cylinder 5, which in turn transfers the printing images to the printing substrates 6. The latter are guided through the machine by a transport belt 11, the printing substrates 6 passing the printing units 1 one after another. The drive is provided via a drive roll (not illustrated) for the transport belt 11, the transport belt 11 driving the image transfer cylinders 5 and the latter in turn driving the image cylinders 2. For the purpose of transmitting force between the transport belt 11 and the image transfer cylinder 5, a backpressure cylinder 12 is provided, which generates the necessary pressing force $F_{(s)}$ of the transport belt 11 against the image transfer cylinder 5.

In the case of such a drive, the problem occurs that the transport belt 11, which moves in the direction of the arrow 28, is partly covered by printing substrates 6, between which, however, there are printing-substrate-free gaps. If there is no printing substrate 6 on the transport belt 11, then the effective radius r with respect to the drive is lower than during the transfer of an image to a printing substrate 6, since the latter adheres to the image transfer cylinder 5 for some time in the force and image transmission area 9 and, as a result, enlarges the effective radius r with respect to the original radius $r_{ü}$ of the image transfer cylinder 5.

In addition to this radius enlargement, however, another effect occurs, which can be attributed to the fact that the image transfer cylinders 5 are each equipped with a resilient cover 7 which deforms in the force transmission area 9, this deformation being different depending on whether or not there is a printing substrate 6 on the transport belt 11. This deformation occurs both in the force transmission area 9 between the image transfer cylinder 5 and the printing substrates 6 or the transport belt 11, and in the force transmission area 8 between the image transfer cylinder 5 and the image cylinder 2. Here, the deformation 10 in the force transmission area 8 is different from the deformation 10' in the force transmission area 9. The force transmission area 8 is determined by the mounting of the image cylinder 2 and of the image transfer cylinder 5, so that discontinuities in this deformation area 10 occur merely as a result of the fact that the radius $r_B$ of the image cylinder 2 exhibits fluctuations. Compensating for these fluctuations is the subject of mentioned application DE 199 34 658. However, the subject of the invention is the compensation of the fluctuations by the alternating deformation 10' in the force transmission area 9, such deformation substantially being determined by the presence or absence of printing substrates 6.

Figure 6A:
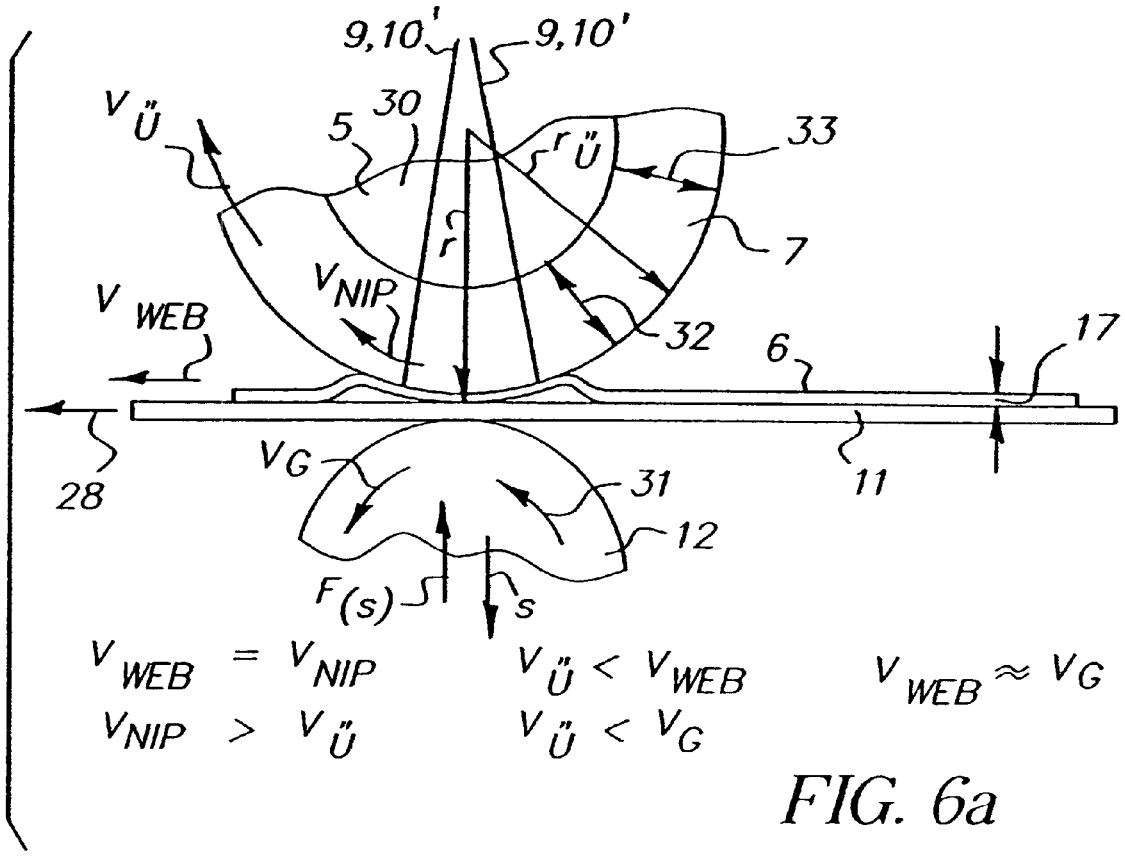
FIGS. 6*a* and 6*b* show an explanation of the overdrive effect.
Figure 6B:
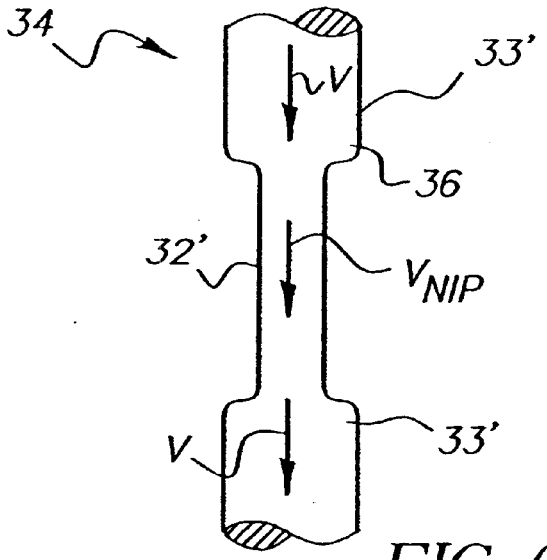

As explained in still more detail in relation to FIGS. 6*a* and 6*b*, not only the enlargement of the radius r, but also the deformation 10' of the resilient cover 7 on a hard core 30 of the image transfer cylinder 5 acts, with the effect that, without the measure according to the invention, the image transfer cylinder 5 rotates more slowly than corresponds to the speed $v_{WEB}$ of the transport belt 11. Since the deformation 10' occurs or does not occur alternatingly as a result of the printing substrates 6, a measure is provided which prevents any discontinuity in the speed $v_{ü}$ of the image transfer cylinder 5.

The measure according to the invention provides for the backpressure cylinder 5 to have a mounting 26 which can be displaced in the direction of the double arrow 27 against the force $F_{(s)}$ of a force element 13. The force element 13 can have an extremely wide range of configurations; the significant factor is that the force $F_{(s)}$ decreases as a function of travel. This reduction in force is necessary in order to control the overdrive effect already mentioned and explained in relation to FIGS. 6*a* and 6*b*, with the effect that an enlarged radius r, for example resulting from the presence of a printing substrate 6, is opposed by such a reduction in the overdrive that the speed $v_{ü}$ of the image transfer cylinder 5 is continuously independent of the presence of printing substrates 6 on the transport belt 11, that is to say, therefore, that the effect of the reduced overdrive always cancels out the effect of the enlarged radius.

In the exemplary embodiment of FIG. 1, provision is made for the force element 13 to be a controlled actuating element 14, a sensor 15 registering the thickness 17 of the printing substrates 6 and transmitting it to a controller 16, which controls the controlled actuating element 14 in such a way that the aforementioned effect occurs, that is to say the force $F_{(s)}$ brings about the compensation of the speed differences. The directions of rotation of the cylinders 2, 5 and 12 are represented by the arrows 31. The arrows 29 show the thickness of the resilient cover 7, which is reduced in the areas of the deformations 10 and 10', the overdrive effect being produced. The effective radius r is produced by a reduction in the radius $r_{ü}$ through the deformation 10', and also an addition of the thickness 17 of the substrate 6, the reduction and substrate thickness 17 not canceling each other out but instead an enlargement of the radius r with respect to the radius $r_{ü}$ remaining over, which must be compensated for by the reduction in the overdrive.

Figure 2:
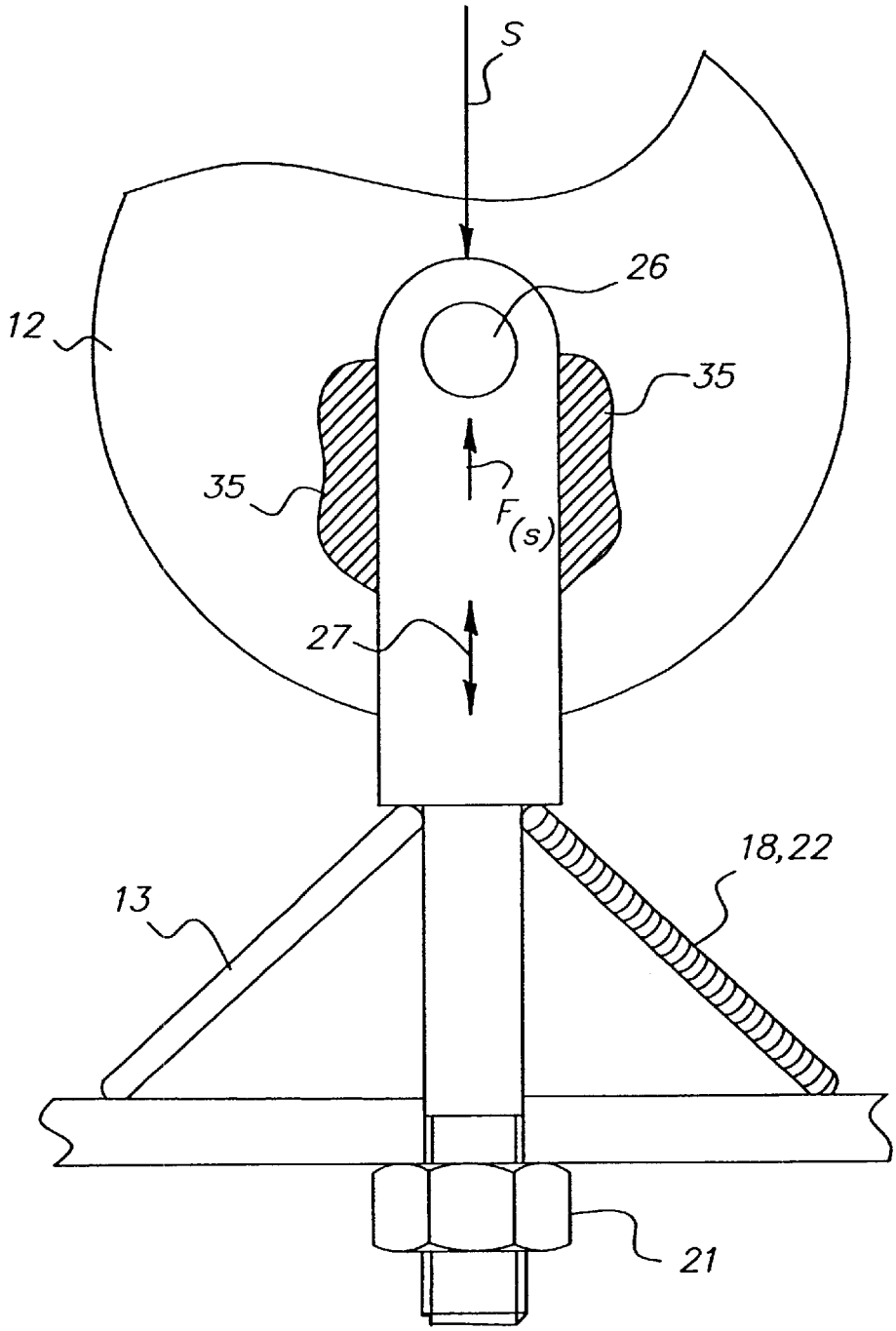
FIG. 2 shows a configuration of a force element with disk springs.

FIG. 2 shows an alternative configuration of a force element 13, in which the reduction in the force $F_{(s)}$ as a function of the travel s (distance of movement of force element) is achieved by springs 18 which are disk springs 22. These disk springs 22 support the mountings 26 of the backpressure cylinder 12, which are mounted in guides 35, on both sides. Such disk springs 22 have a force/travel characteristic curve 19 (FIG. 3) which, in a zone 20, has a falling characteristic curve, which can be employed as a working zone. In order to set this falling characteristic-curve zone 20 as a working zone, there is an adjusting element 21, which, for example, can be formed by a nut and bolt.

Figure 3:
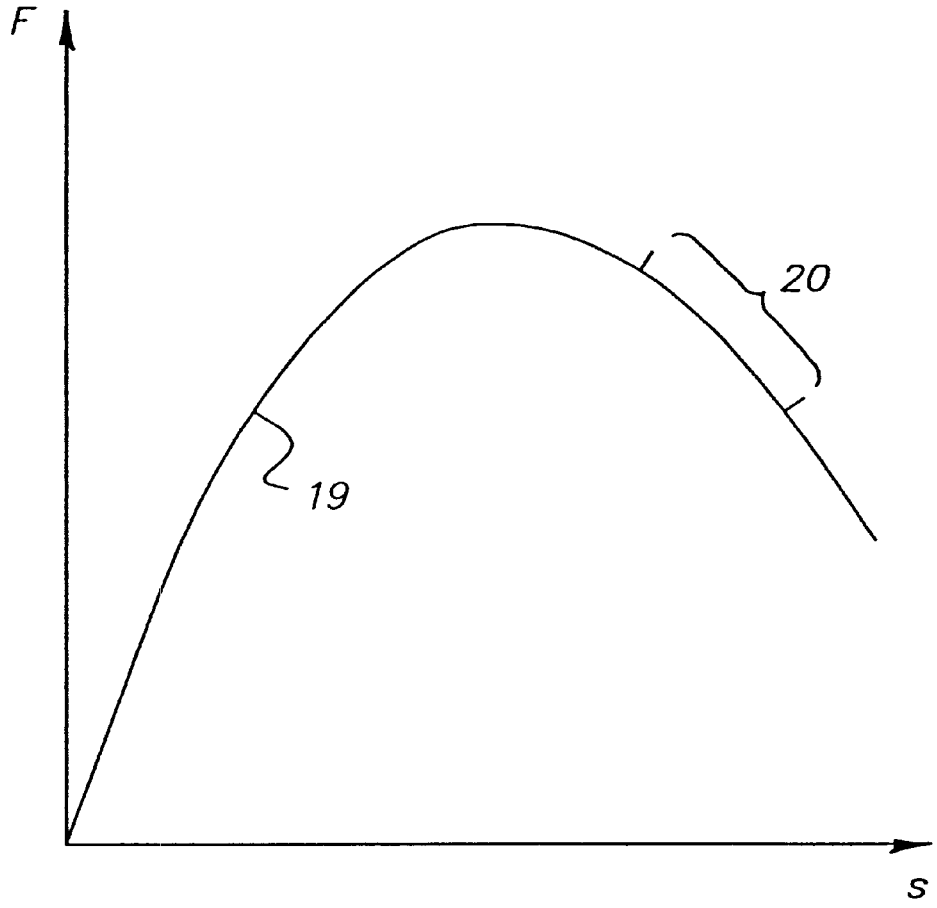
FIG. 3 shows a force/travel graph of such a force element.

FIG. 3 shows a force/travel graph of a force element 13 of this type, for example one such having disk springs 22. The force/travel characteristic curve 19 has the aforementioned falling characteristic-curve zone 20, which can be used, as a working zone. If this falling characteristic-curve zone 20 is set exactly such that it generates the force $F_{(s)}$ needed for the compensation, then one force element 13 can effect the compensation automatically, it being irrespective whether the increase in the radius r is caused only by the printing substrates 6 or whether there are also fluctuations present in the radius $r_{ü}$ of the image transfer cylinder 5, which can likewise be compensated for in the aforementioned manner.

Figure 4:
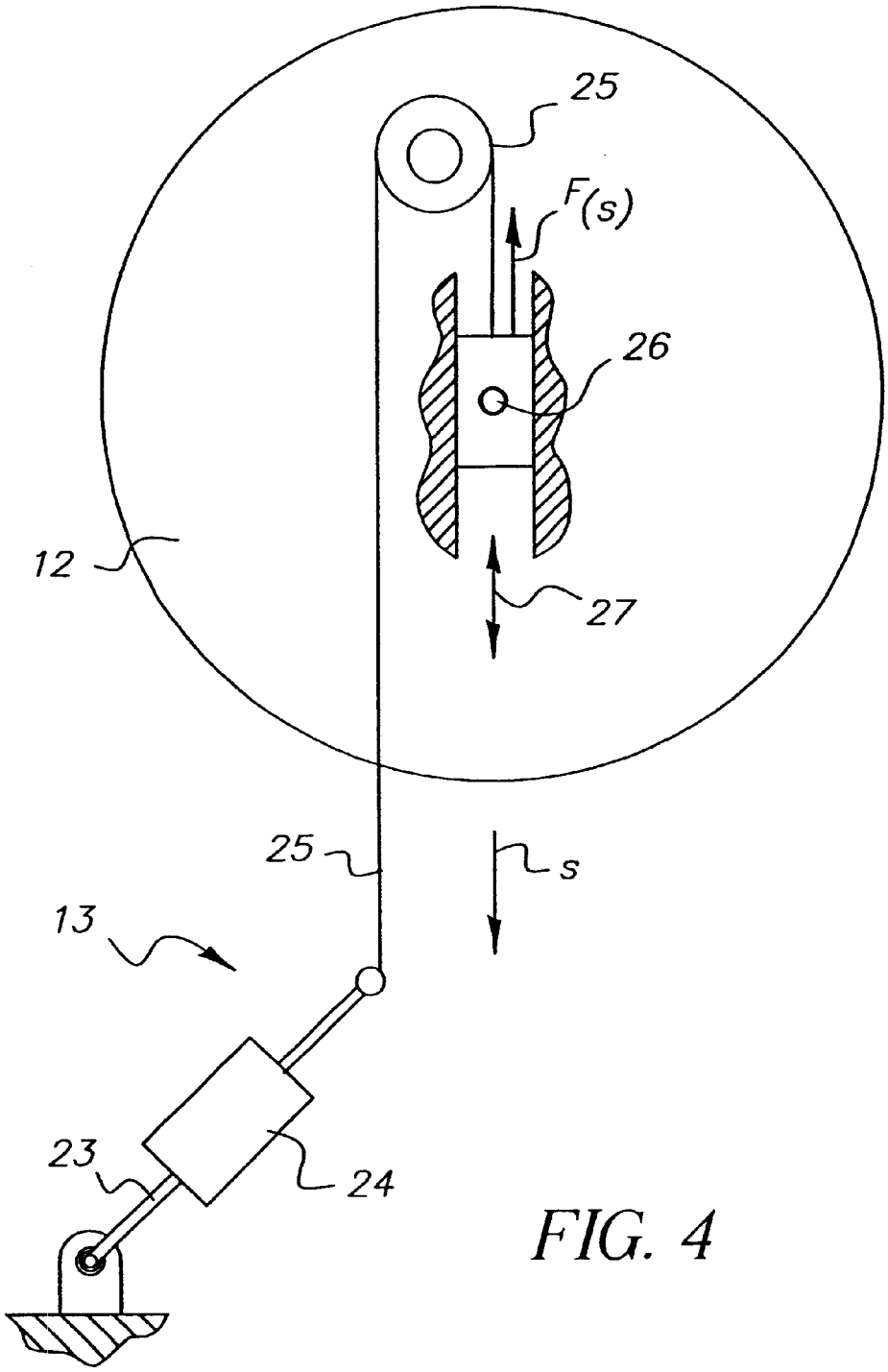
FIG. 4 shows a configuration of a force element with lever and weight.

FIG. 4 shows a configuration of a force element 13 with a lever 23 and a weight 24, and also a force transmission element 25. Since here the effective lever arm of the lever 23 is shortened as a function of the travel s, a reduction in the force F which is likewise dependent on the travel s occurs. However, this illustration is a basic sketch, since the force transmission element is illustrated only symbolically. The travel s which is caused by the substrate thickness 17 is very small, and it would therefore be necessary for a force transmission element 25 with a corresponding step-up ratio to be provided, and would have to be configured appropriately, but this will not be discussed specifically here.

Figure 5:
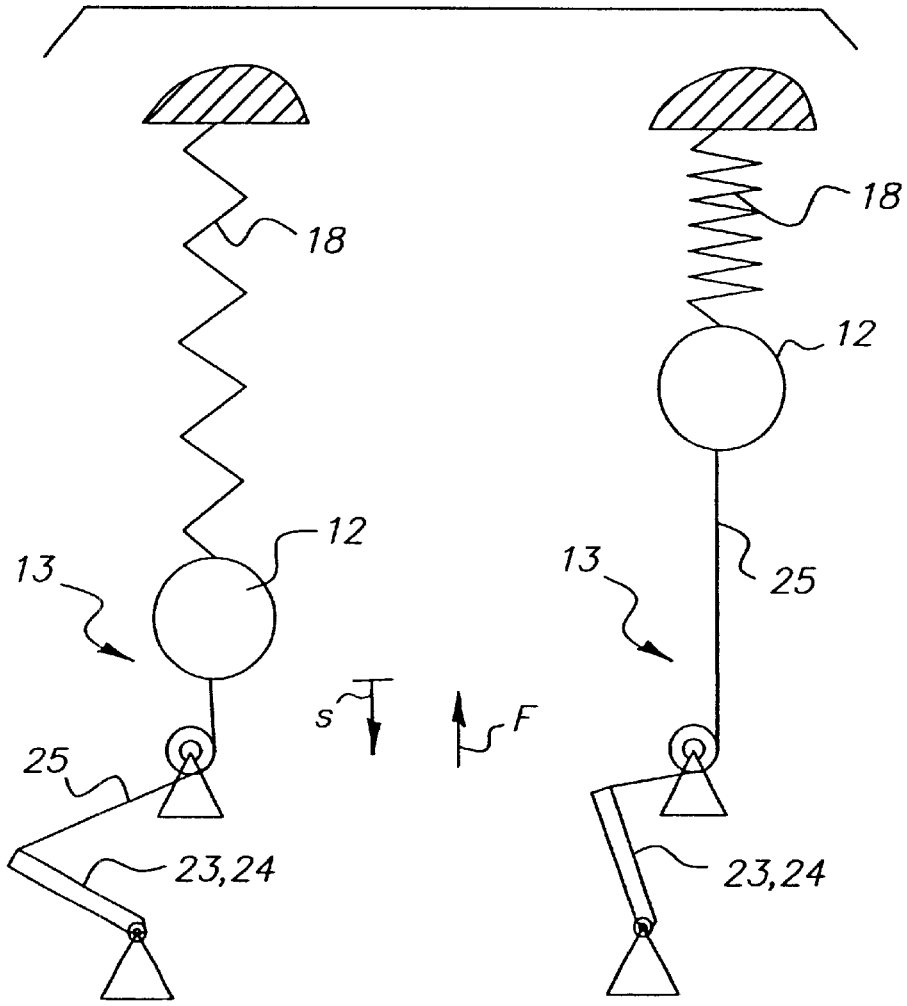
FIG. 5 shows a configuration of a force element with a combination of two force-generating elements.

FIG. 5 also shows a configuration of a force element 13 as a basic illustration. This is a combination of two force-generating elements, a spring 18 and a weight-lever system 23, 24 and 25, with which the characteristic-curve zone 20, described in relation to FIG. 3, can likewise be achieved. Also represented symbolically here is the force transmission element 25. Because of the small travel s, caused by the thickness 17 of a substrate 6, it would also have to be provided with further step-up transmission.

The overdrive effect is to be explained by using FIGS. 6*a* and 6*b*. In this case, FIG. 6*a* shows a detail from a printing unit 1 according to the invention in the area of the image transfer to a printing substrate 6. During the transfer of the image from the image transfer cylinder 5 to the printing substrate 6, a deformation 10' of the resilient cover 7 takes place in the image transfer area 9, the resilient cover 7 being compressed with respect to its normal thickness 11 at a constriction 32 and, after passing through the image transfer area 9, expanding again to the normal width 33. This leads to the effect that the speed $v_{NIP}$ of the resilient material at the constriction 32 is higher than the speed $v_{ü}$ of the image transfer cylinder 5. Since the speed $v_{WEB}$ of the transport belt 11 corresponds to the speed $v_{NIP}$ of the resilient cover at the constriction 32, this means that the speed $v_{ü}$ of the image transfer cylinder 5 is also lower than the speed $v_{WEB}$ of the transport belt 11.

FIG. 6*b* illustrates this with an analog effect which occurs in the case of a piping system 34 which is filled with a liquid 36 and likewise leads from a normal width 33' to a constriction 32', in order subsequently to widen again to the normal width 33'. Here, too, in the area of the normal width 33', the liquid 36 has a normal speed v, which is increased at the constriction 32' to a speed $v_{NIP}$, in order subsequently to assume the normal speed v again. A resilient cover 7 behaves in the same way when it is forced to pass through a constriction 32 by a pressure. This effect occurs in FIG. 6*a* in the area 9 of the resilient cover 7 and leads to the transport belt 11 not transmitting its full speed $v_{WEB}$to the image transfer cylinder 5, since the speed of the resilient material after the constriction 32 is reduced from the speed $v_{NIP}$to the speed $v_{ü}$.

In addition to this speed-reducing overdrive effect, there is added the fact that the printing substrate 6 bears somewhat on the surface of the image transfer cylinder 5 in the area 9 and, as a result, the radius $r_{ü}$ of the image transfer cylinder 5 is increased somewhat to the effective radius r. This arises since the reduction in the normal width 33 of the resilient cover 7 to the constriction 32 is somewhat lower than the substrate thickness 17, which is added to the radius of the image cylinder 2 in the force transmission area 9. There therefore remains a certain enlargement in the radius, which in turn leads to a reduction in the speed.

However, the last-named reduction in the speed occurs discontinuously, since printing substrates 6 and printing-substrate-free gaps alternate on the transport belt 11. If the back-pressure cylinder 12 were installed rigidly, then each time a printing substrate 6 passed, then both an enlargement in radius and an increased overdrive would act, and the drive to the image transfer cylinder and therefore to the image cylinder 2 would be discontinuous, which would lead to image defects or would have to be compensated for in a complicated manner during the setting of the image on the image cylinder 2 by the image generating device 3.

The invention therefore provides for the travel-dependent pressing force $F_{(s)}$ not to increase as a function of the travel s, as would be the case with a rigid system, when a printing substrate 6 has to pass the image transfer cylinder 5; instead, provision is made for the travel-dependent pressing force $F_{(s)}$ to decrease as a function of the travel s in such a way that, in the area of a printing substrate 6, decreasing overdrive compensates for the radius $r_{\ddot{u}}$ increasing to the radius r, in such a way that the speed $v_{\ddot{u}}$ of the image transfer cylinder 5 always has a constant ratio to the speed $v_{WEB}$ of the transport belt 11. In this case, identity of the speeds $v_{\ddot{u}}$ and $v_{WEB}$ is not achieved, instead a constant ratio is sufficient, since speed differences which remain constant can easily be taken into account during the image generation by the image-generating device 3. The significant factor is that no speed fluctuations occur.

In FIG. 6*a*, although a further effect is added, namely that the transport belt 11 likewise has a certain elasticity and therefore a slight overdrive effect also occurs in this regard, this effect can be disregarded or, since it occurs continuously, can be compensated for by the image generation.

It is essential to the invention that the principle explained is implemented. Whether this is implemented by passive components or by active components, that is to say with the aid of a control system, is ultimately a question of cost-effective implementation and a question as to the extent to which the most optimal compensation can be achieved, that is to say how the dependence of the force F on the travel can be matched in an optimum way to the change in the relationships which occur when pressure substrates 6 and printing-substrate-free gaps alternate.

The invention and its advantages will be better understood from the ensuing detailed description of preferred embodiments, reference being made to the accompanying drawings in which like reference characters denote like parts.

I claim:

1. A printing unit (1) for a printing machine, having an image cylinder (2), an image generating device (3) for setting an image on the peripheral surface (4) of the image cylinder (2), and an image transfer cylinder (5) which transfers the image from the image cylinder (2) to a printing substrate (6), the image transfer cylinder (5) having a resilient cover (7) which exhibits a deformation (10, 10') in respective force transmission areas (8, 9), between the image cylinder and the image transfer cylinder, and the image transfer cylinder and a transport belt (11) that carries the printing substrates (6), and is supported by a back-pressure cylinder (12) driving the image transfer cylinder (5) and the latter driving the image cylinder (2), by friction, comprising: a mount for said back-pressure cylinder (12), said mount including a device (13, 14) for selectively displacing said back-press cylinder with respect to the image transfer cylinder (5) with a pressing force ($F_{(S)}$), a sensor (15) to register the substrate thickness, and a control system (16), the latter determining the pressing force ($F_{(S)}$) with the aid of the substrate thickness (17) such that the speed of the image cylinder (2) remains constant with respect to changes in the effective radius (r) for driving the image transfer cylinder (5).

2. The printing unit as claimed in claim 1, wherein the device (13) includes a piston-cylinder arrangement, and wherein the pressing force ($F_{(s)}$) provided by the piston-cylinder arrangement of the device (13) is such that the product of the transmission ratio that results from the respective effective radius (r) and the transmission ratio that results from the respective deformations of the resilient material (7) in the force transmission area (9) between the transport belt (10),—with or without the printing substrate (6),—and the image transfer cylinder (5) remains constant.

3. The printing unit as claimed in claim 1, wherein the force element (13) includes a piston-cylinder arrangement which is operated by a fluid or pneumatic medium.

4. The printing unit as claimed in claim 1, wherein the force element (13) includes springs (18) which act on the back-pressure cylinder (12) with the pressing force ($F_{(s)}$).

5. The printing unit as claimed in claim 4, wherein the springs (18), are selected so as, at least in one characteristic-curve zone (20), to exhibit a falling force per unit of travel characteristic (19).

6. The printing unit as claimed in claim 5, wherein the springs (18) have an adjusting element (21) with which the characteristic-curve zone (20) can be set as a working zone.

7. The printing unit as claimed in claim 4, wherein the springs (18) are disk springs (22).

8. The printing unit as claimed in claim 1, wherein the force element (13) is a lever-mounted weight (23 and 24).

9. The printing unit as claimed in claim 1, wherein the force element (13) is a combination of at least two force-generating elements (14, 18, 22, 23 and 24).

10. The printing unit as claimed in claim 9, wherein the sum of the force/travel characteristic curves (19) of the force-generating elements (18, 23 and 24) results in at least one falling characteristic-curve zone (20).

* * * * *